United States Patent [19]

Nagaishi

[11] Patent Number: 4,841,937

[45] Date of Patent: Jun. 27, 1989

[54] AIR/FUEL RATIO CONTROL SYSTEM FOR INTERNAL COMBUSTION ENGINE WITH ASYNCHRONOUS FUEL DELIVERY CONTROL

[75] Inventor: Hatsuo Nagaishi, Kanagawa, Japan

[73] Assignee: Nissan Motor Co., Ltd., Yokohama, Japan

[21] Appl. No.: 213,952

[22] Filed: Jul. 1, 1988

[30] Foreign Application Priority Data

Jul. 2, 1987 [JP] Japan ..... 62-166183

[51] Int. Cl.[4] ..... F02M 51/00

[52] U.S. Cl. ..... 123/492; 364/431.07

[58] Field of Search ..... 123/492, 480, 486, 493, 123/494, 495, 489, 352; 364/431.07, 431.05; 180/176

[56] References Cited

U.S. PATENT DOCUMENTS

| | | | |
|---|---|---|---|
| 4,640,254 | 2/1987 | Ninomiya | 123/492 |
| 4,690,117 | 9/1987 | Isaba et al. | 123/492 |
| 4,707,792 | 11/1987 | Naitou | 364/431.07 |
| 4,712,529 | 12/1987 | Tetasaka et al. | 123/492 |
| 4,751,909 | 6/1988 | Otoba | 123/492 |

*Primary Examiner*—Raymond A. Nelli

*Attorney, Agent, or Firm*—Foley & Lardner, Schwartz, Jeffery, Schwaab, Mack, Blumenthal & Evans

[57] ABSTRACT

An air/fuel ratio control system monitors engine load variation for generating an engine load variation indicative data. The system includes means for integrating the engine load variation indicative data to trigger asynchronous fuel delivery when the integrated value reaches a predetermined threshold value. The integrated value is cleared simultaneously with triggering the asynchronous fuel delivery.

14 Claims, 5 Drawing Sheets

AIR/FUEL RATIO CONTROL SYSTEM FOR INTERNAL COMBUSTION ENGINE WITH ASYNCHRONOUS FUEL DELIVERY CONTROL

BACKGROUND OF THE INVENTION

1. Field of the Invention

The present invention relates generally to an air/fuel ratio control system for an internal combustion engine. More specifically, the invention relates to an asynchronous fuel delivery control in an air/fuel ratio control for improving an engine driving characteristics.

2. Description of the Background Art

As is well known, asynchronous fuel delivery is performed in response to a demand of acceleration enrichment. Especially, such asynchronous fuel delivery is important for providing better acceleration characteristics in a single-point injection type fuel injection system for an internal combustion engine. Generally, acceleration enrichment demand is detected by means of an idle switch position or throttle valve angular position. In case that the idle switch position is taken as a parameter for detecting acceleration, switching of idle switch from ON position to OFF position is detected to detect the acceleration enrichment demand. On the other hand, when the throttle angular position is taken as parameter for detecting the acceleration enrichment demand, variation rate of throttle angular position is compared with a predetermined threshold in order to detect the engine driving condition requiring enrichment for acceleration. Asynchronous fuel injection is performed when acceleration enrichment demand is detected based on the selected parameter as set forth above. Fuel injection amount to be injected in asynchronous injection is derived on the basis of an engine coolant temperature and magnitude of acceleration demand, such as the throttle angle variation rate.

Fuel injection amount control in asynchronous injection has been disclosed in Japanese Patent First (unexamined) Publication (Tokkai) Showa No. 59-200034.

When asynchronous fuel injection for acceleration enrichment is controlled on the basis of the idle switch position, there is no way for distinguishing moderate acceleration and abrupt or swift acceleration. Therefore, in either condition, same acceleration enrichment wil be performed to make an air/fuel mixture excessively rich in moderate acceleration or to make air/fuel ratio excessively lean in abrupt acceleration.

On the other hand, by taking the throttle valve angular position as parameter for detecting the acceleration enrichment demand, moderate acceleration and abrupt acceleration can be distinguished. However, in such case, an enrichment demand for moderate acceleration will be ignored. Namely, as long as the throttle angle variation rate is held smaller than the threshold, asynchronous fuel injection is not performed. In such throttle angle variation range, variation rate of the throttle angular position is not reflected to engine acceleration characteristics. This tends to degrade engine acceleration in certain range of engine acceleration.

SUMMARY OF THE INVENTION

Therefore, it is an object of the present invention to provide an air/fuel ratio control system which can improve engine acceleration characteristics even in moderate acceleration.

Another object of the invention is to provide an asynchronous fuel delivery control which can enrich air/fuel ratio in response to acceleration enrichment demand in even moderate acceleration range.

In order to accomplish aforementioned and other objects, an air/fuel ratio control system, according to the present invention, monitors engine load variation for generating an engine load variation indicative data. The system includes means for integrating the engine load variation indicative data to trigger asynchronous fuel delivery when the integrated value reaches a predetermined threshold value. The integrated value is cleared simultaneously with triggering the asynchronous fuel delivery. According to one aspect of the invention, an air/fuel ratio control system comprises a fuel metering means for metering a controlled amount of fuel into flow of intake air for establishing an air/fuel mixture, an engine speed sensor for monitoring an engine revolution speed for producing an engine speed inactive signal, an engine load sensor for monitoring an engine load for producing an engine load signal, first means for detecting variation of the engine load for generating an engine load variation data, second means for detecting variation magnitude of engine load exceeding a predetermined threshold value for producing a detecting signal, third means for deriving a fuel metering amount and controlling the fuel metering means in order to meter derived first amount of fuel to the intake air flow at a controlled timing normally in synchronism with engine revolution cycle, the third means being responsive to the detecting signal for second deriving a fuel metering amount so as to meter derived amount of fuel at a timing irrespective of the engine revolution cycle.

According to another aspect of the invention, an air/fuel ratio control system comprises a fuel injection valve for injecting a controlled amount of fuel into intake air flowing through an air induction passage for establishing an air/fuel mixture, an engine speed sensor for monitoring an engine revolution speed for producing an engine speed indicative signal, an engine load sensor for monitoring an engine load for producing an engine load indicative signal, first means for monitoring variation of engine load detecting variation of the engine load indicative signal value and generating an engine load variation magnitude indicative data, second means, receiving the engine load variation magnitude indicative data, for deriving a total engine load variation magnitude, the second means being detective of the total engine load variation magnitude exceeding a predetermined threshold value for producing a detecting signal, and third means, normally operating in synchronous injection mode, for deriving a fuel injection amount and controlling the fuel injection valve in order to inject derived first amount of fuel to the intake air flow at a controlled timing normally in synchronism with engine revolution cycle, the third means being responsive to the detecting signal to be triggered an asynchronous injection mode for deriving a second fuel injection amount so as to inject derived second amount of fuel at a timing determined irrespective of the engine revolution cycle.

In practice, the second means integrates the engine load variation magnitude indicative data for deriving the total engine load variation magnitude and compares integrated value with the predetermined threshold for detecting the total engine load variation magnitude exceeding the threshold.

The third means may further derive a transition compensation correction coefficient for correcting the first injection amount on the basis of deviation of the second fuel injection amount and necessary fuel injection amount which is derived on the basis of the engine speed data and the engine load data for compensating the deviation. The transition compensation correction coefficient is variable depending upon the engine lead variation magnitude detected by the second means.

The third means derives an acceleration enrichment correction coefficient on the basis of the engine load variation magnitude detected by the second means for deriving the second fuel injection amount. The third means further detects engine load variation rate on the basis of the engine load variation data of the first means for discriminating rapid acceleration and moderate acceleration for differentiating the acceleration enrichment correction coefficient depending thereon.

The second means is responsive to fuel injection irrespective of engine revolution cycle to clear the integrated value.

DESCRIPTION OF THE PREFERRED EMBODIMENT

Figure 1:
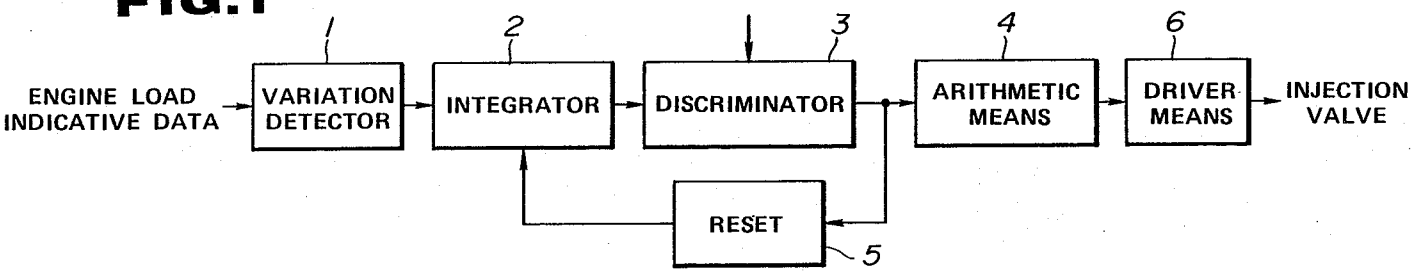
FIG. 1 is a schematic block diagram of the preferred embodiment of an air/fuel ratio control system according to the invention.

Referring now to the drawings, particularly to FIG. 1, the preferred embodiment of an air/fuel ratio control system, according to the present invention, includes an asynchronous injection control system. As will be appreciated, FIG. 1 schematically shows asynchronous injection control system in the air/fuel ratio control system. It should be appreciated the words "synchronous injection" is used through the disclosure to represent the meaning that fuel injection is regularly performed at a timing derived in synchronism with engine revolution cycle. Namely, timing for "synchronous injection" is determined in relation to intake valve opening timing of the corresponding engine cylinder in case of multi-point injection, such as so-called sequential injection or in relation to reference angular position of the crank shaft in case of a single point injection. On the other hand, the word "asynchronous injection" used in the disclosure represents fuel injection initiated at a timing determined irrespective of the engine revolution cycle for acceleration enrichment in response to increase of engine load representing acceleration demand.

Though FIG. 1 neglect the normal mode fuel injection control system, it should be appreciated that the normal mode fuel injection control system can be constructed in various ways and thus should not be regarded as essential feature of the invention.

The asynchronous injection control system, as illustrated in FIG. 1, has a sensor means for monitoring the engine driving condition as an air/fuel ratio control parameters. The sensor means includes an engine load sensor which monitors load condition on the engine to produce an engine load indicative signal. As the engine load sensor, an air flow meter for monitoring an intake air flow rate, a throttle angle sensor for monitoring a throttle valve angular position, a vacuum sensor for monitoring an intake vacuum and so forth can be employed. In the shown embodiment, the throttle angular position data is taken as a data indicative of an intake air flow rate. The manner of derivation of the intake air flow rate based on the throttle angular position data will be discussed later.

The preferred embodiment of the air/fuel ratio control system employs a variation detector means 1 which receives the at least the engine load indicative data as derived from the throttle angle sensor signal. The variation detector means 1 compares the instantaneous engine load indicative data with the engine load indicative data obtained in the immediately preceding operation cycle to obtain a difference data. The variation detector means 1 feeds the difference data to an integrator means 2. The integrator means 2 integrates the difference data to output an integrated data as engine driving condition variation indicative data. A discriminator means 3 receives this engine driving condition variation data to compare with a given criterion for initiating asynchronous injection when the engine driving condition variation data is greater than or equal to the given criterion. In the practical operation, the discriminator means 3 outputs an asynchronous injection demand indicative discriminator signal in response to the engine driving condition variation indicative data to an arithmetic means 4 which is responsive to the discriminator signal to perform arithmetic operation for deriving fuel injection amount for asynchronous injection. Various ways and various parameters are taken, in practice, for deriving the asynchronous fuel injection amount, example of which will be discussed later.

The arithmetic means 4 feeds the resultant fuel injection amount data in a form of a pulse signal having a pulse width corresponding to the fuel amount to be injected. The fuel injection amount data is set in a driver means 5 which is associated with a fuel injection valve to drive the latter for injecting fuel for a period defined by the pulse width.

The discriminator signal of the discriminator means 3 is simultaneously fed to the integrator means 2 and serves as reset signal for clearing the integrated value.

Further detail of the preferred embodiment of the air/fuel ratio control system, according to the present invention, will be disclosed herebelow with reference to FIGS. 2 through 5.

Figure 2:
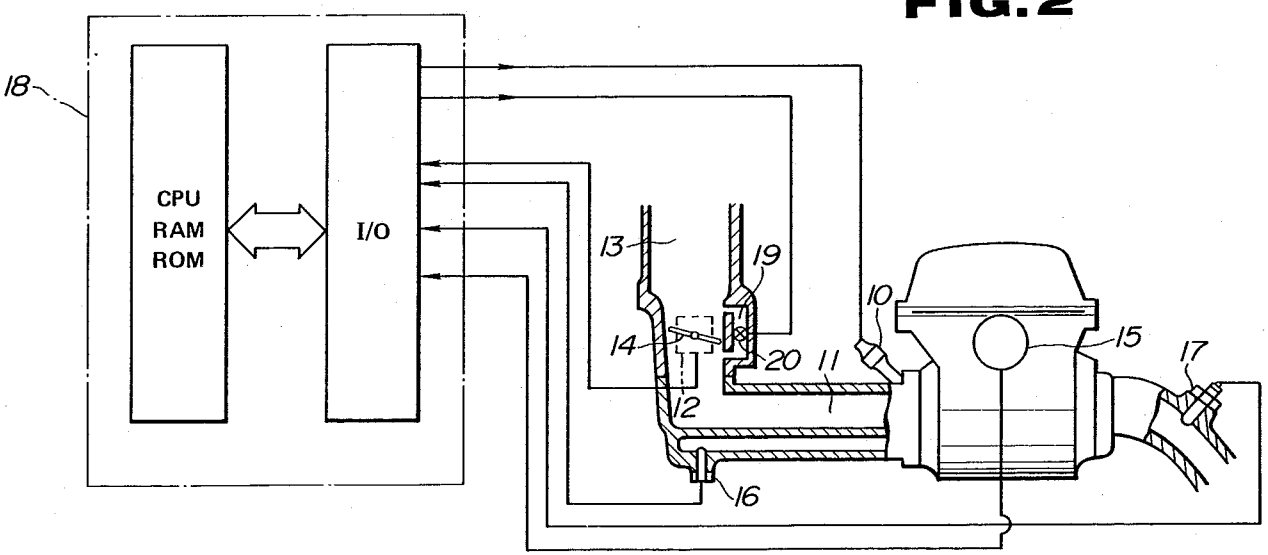
FIG. 2 is a diagrammatical illustration of the preferred embodiment of the air/fuel control system of FIG. 1.

FIG. 2 shows a sequential injection type, 6-cylinder fuel injection internal combustion engine, to which the preferred embodiment of the air/fuel ratio control system is applied. The engine has an intake port for each engine cylinder associated with an intake valve. The intake port is connected to an intake manifold 11 of an air induction system 13. A fuel injection valve 10 is inserted to the intake manifold 11 corresponding to each engine cylinder for injecting a controlled amount of fuel thereinto to form an air/fuel mixture.

A throttle chamber is formed in the air intake system 13, in which a throttle valve 14 is rotatably disposed. A throttle angle sensor 12 is associated with the throttle valve 14 for monitoring angular position of the latter to produce an analog form throttle angular position indicative signal TVO.

A crank angle sensor 15 is provided for monitoring angular position of a crankshaft to produce a crank reference signal $\theta_{ref}$ at every predetermined angular positions, e.g. every 70° BTDC (before top-dead-center) position, of the crankshaft and a crank position signal $\theta_{pos}$ at every given angular displacement, e.g. 1°. In the shown embodiment, the crank angle sensor 15 is illustrated in a form directly associated with the crankshaft. However, it is possible to facilitate the crank angle sensor 15 in an engine accessory, such as a distributor, which rotates in synchronism with engine revolution for monitoring the crankshaft angular positions.

In the shown embodiment, an engine coolant passage extends in the intake manifold 11 for heating intake air for obtaining better fuel atomization characteristics. An engine coolant temperature sensor 16 is disposed within the engine coolant passage to monitor an engine coolant temperature to produce an engine coolant temperature indicative signal Tw.

On the other hand, an oxygen ($O_2$) sensor 17 is disposed within an exhaust passage for monitoring oxygen concentration contained in exhaust gas to produce an $O_2$ signal.

The shown embodiment further includes an auxiliary air passage 19 by-passing the throttle chamber for introducing an auxiliary air into the engine cylinder. An electromagnetically operable idling air control valve 20 is disposed in the auxiliary air passage. The idling air control valve 20 is controlled by a pulse train form idle control signal having a variable duty cycle defining the auxiliary air flow rate to pass through the auxiliary air passage.

The throttle angle sensor 12, the crank angle sensor 15, the engine coolant temperature sensor 16 and $O_2$ sensor 17 are connected to a control unit 100 to input data respectively representing the engine operating parameters for controlling fuel injection amount and thus for controlling air/fuel ratio. The control unit 100 comprises a microprocessor and designed for performing a fuel injection control and air/fuel ratio control based on the input engine operation parameters.

The control unit 100 may derive engine revolution speed (hereafter "engine speed") N on the basis of one of the crank reference signal $\theta_{ref}$ and the crank position signal $\theta_{pos}$. Practically, when the engine speed N is derived on the basis of the crank reference signal $\theta_{ref}$, an interval of occurrence of sequentially occurring crank reference signals is measured and a reciprocal of the measured interval is used as engine speed representing data. On the other hand, when the crank position signal $\theta_{pos}$ is used for deriving the engine speed N, the crank position signal is counted for a given period or a period of time in which a given number of crank position signal is received is measured. In the former case, the engine speed N is derived in a value proportional to the counted value of the crank position signals. On the other hand, in the latter case, a reciprocal of the measured period is divided by the given number of the crank position signal to obtain the pulse interval and a reciprocal of the obtained interval is used as the engine speed data N.

As will be appreciated, the shown embodiment of the air/fuel ratio control system does not include an air flow meter or other facility for directly monitoring the engine load condition Q. In the shown embodiment, the throttle angular position TVO is taken as a parameter representing the engine load condition Q. Engine load data Q derived on the basis of the throttle angular position indicative signal TVO is advantageously introduced for avoidance of fluctuation of the measured intake air flow rate due to pulsatile flow of the air and of influence of the environmental temperature condition.

Process of derivation of the intake air flow rate Q will be discussed herebelow.

In the shown embodiment, intake air flow rate is preferably derived with respect to each engine cylinder for higher precision of fuel injection amount control. A process for deriving an intake air volume QCYL to be introduced into the engine cylinder. Basically, the shown embodiment is designed to derive the intake air volume QCYL on the basis of the throttle angle indicative signal $\theta_{th}$ and an engine speed data N. In practice, the engine speed data N is derived on the basis of the crank reference signal $\theta_{ref}$ or the crank position signal $\theta_{pos}$. Namely, in case that the engine speed data N is derived on the basis of a frequency of the crank position signal $\theta_{pos}$, the crank position signals $\theta_{pos}$ is counted within a predetermined period. For this purpose, an engine speed counter (not shown) may be provided in the input/output unit. The engine speed counter may be triggered at the initial stage of process for deriving the engine speed data N. At the same time, an engine speed timer (not shown) is also triggered to measure the predetermined period. When the timer value of the engine speed timer reaches a given value corresponding to the predetermined period, the counter value of the engine counter is latched. The latched counter value is processed to derive the engine speed data N. The process for deriving the engine speed data N based on the count of the crank position signal $\theta_{pos}$ is well known technique and require no detailed discussion.

In the alternative, the engine speed data N can be obtained by measuring an interval of occurrences of the crank reference signals $\theta_{ref}$. Namely, the period of the pulse form crank reference signal $\theta_{ref}$ is inversely proportional to the engine speed, the engine speed data can be obtained by obtaining reciprocal of the pulse period of the crank reference signal $\theta_{ref}$. This procedure in derivation of the engine speed data N may be preferred when the economical system rather than high precision is required.

The process may be triggered with a predetermined interval, e.g. 20 ms to update the intake air volume data QCYL. At first, a path area $A_{th}$ variable depending upon the throttle valve open angle in terms of the throttle angle indicative signal is derived. The path area $A_{th}$ at the throttle valve to flow the intake air will be hereafter referred to as "throttle valve path area". The idling air control signal ISCD which is pulse signal having duty cycle defining open and close period of the idling speed control valve 27 is received to derive the idling air path area $A_{BY}$. The path area derived will be hereafter referred to as "by-pass passage path area".

A total intake air path area A is calculated by adding the by-pass passage path area $A_{BY}$ to the throttle valve path area $A_{th}$. Based on the total intake air path area A as derived, a ratio of the total intake air path area A versus the engine speed N is calculated. The ratio of the total intake air path area A versus the engine speed N will be hereafter referred to as A/N ratio. A linearized intake air flow amount $Q_{HO}$ is determined on the basis is the A/N ratio. The linearized air flow amount $Q_{HO}$ represents basic intake air volume in steady or stable engine driving condition.

It should be noted that though the shown embodiment derives the linealized air flow amount $Q_{HO}$ based on the A/N ratio, it may be possible to utilize a $A/(N\times V)$ ratio with taking the volume V of the engine cylinder.

Then, based on the linearized intake air flow amount $Q_{HO}$ and the engine speed N, an intake air volume correction coefficient KFLAT is derived, which correction coefficient KFLAT will be hereafter referred to as "KFLAT value". This KFLAT value is introduced in derivation of the intake air flow amount as a correction factor for obtaining constant air/fuel ratio, e.g. stoichiometric value of air/fuel ratio by compensating possible deviation of the actual air/fuel ratio and the stoichiometric value caused by maintaining air/fuel ratio control based on the linearized air flow amount $Q_{HO}$.

Based on the linearized intake air flow amount $Q_{HO}$ and the KFLAT value a steady state air flow amount $Q_H$ is derived by modifying the linealized air flow amount $Q_{HO}$ by the KFLAT value. Thereafter, a delay time based correction coefficient $K_2$ is derived on the basis of the total intake air path area A and the engine speed N. The delay time based correction coefficient $K_2$ is set in view of the delay time of introduction of the air past the throttle valve 15 into the engine cylinder. In case the that the $(A/(N\times V))$ is used for deriving the linearized air flow amount $Q_{HO}$, the parameters to be used for deriving the delay time based correction coefficient $K_2$ becomes A and $(N\times V)$.

The intake air volume QCYL is derived from the following equation:

$$QCYL=Q_{CYL\text{-}1}+K_2(Q_H-Q_{CYL\text{-}1})$$

where $Q_{CYL\text{-}1}$ is the intake air volume derived in the immediately preceding calculation cycle. During the engine is driven in steady state, the $Q_{CLY\text{-}1}$ becomes nearly equal or equal to the intake air amount $Q_H$.

The process of derivation of the intake air volume QCYL based on the throttle valve angular position $\theta_{th}$ and the engine speed N has been disclosed in Japanese Patent First (unexamined) Publication (Tokkai) Showa No. 60-39465. The disclosure of this reference will be herein incorporated by reference for the sake of disclosure.

As will be appreciated, since the throttle valve angular position $\theta_{th}$ and the engine speed N are free from influence of pulsatile flow of the intake air, the intake air volume QCYL derived through the foregoing process can be precise with avoiding the influence of the pulsatile flow of the air.

In case of a multi-point injection type fuel injection internal combustion engine, the intake air volume QCYL as derived through the process set forth above, can represents the intake air amount at the position where fuel injection is performed. However, in case of the single-point injection type fuel injection internal combustion engine, intake air flow amount $Q_{AINJ}$ at the position of the fuel injection valve 10 tends to be different from the intake air volume QCYL at the intake port of the engine cylinder. The deviation between $Q_{AINJ}$ and QCYL becomes substantially in the engine transition state where pressure variation occurs in the air induction passage.

In order to compensate this deviation between $Q_{AINJ}$ and QCYL, the control unit executes a deviation compensation. Through the deviation compensation process the intake air flow amount $Q_{AINJ}$ at the fuel injection point can be derived in precise fashion. The intake air amount $Q_{AINJ}$ will be hereafter referred to as "injection point air amount".

A correction value CM is derived according to the following equation:

$$CM=(QCYL-Q_{CYL\text{-}1})\times KMANI$$

where KMANI is a given constant value determined corresponding to volume of the intake air flow path. This correction value CM compensate loss of air volume in the air flow path between the fuel injection valve and the intake port. The injection point air amount $Q_{AINJ}$ is calculated by adding the correction value CM to the intake air volume QCYL. Thereafter, the intake air volume QCYL is registered as $QCYL_{\text{-}1}$ data for the next execution cycle.

In the process set forth above, since the intake air amount $Q_H$ is derived with taking the delay of introduction of the intake air into the engine cylinder by utilizing the delay time based correction coefficient $K_2$, the obtained intake air volume QCYL or the injection point air amount $Q_{AINJ}$ can be precise enough to allow high precision engine control.

The practical process of deriving intake air flow rate discussed hereabove has been disclosed in the co-pending U.S. patent application filed on May 18, 1988, entitled "System for Measuring Amount of Air Introduced into Combustion Chamber of Internal Combustion Engine with Avoiding Infuence of Temperature Dependent Air Density Variation and Pulsatile Air Flow", which application has been filed with claiming convention priority based on Japanese Patent Application No. 62-121496. The disclosure of the above-identified copending U.S. patent application will be herein incorporated by reference for the sake of disclosure.

It should be appreciated that, though the shown embodiment employs the intake air flow rate as discussed above as the engine load parameter, it may be possible to use a basic fuel injection amount Tp derived on the basis of the engine speed data N and intake air flow rate Q can be taken as a data representing the engine load condition.

In normal state air/fuel ratio control, the control unit 100 derives a fuel injection amount Ti which defines a pulse width of a fuel injection pulse to be applied to the fuel injection valve 10 on the basis of various fuel injection control parameters. As is well known, the engine speed data N and the engine load data QCYL are taken as basic parameter for deriving a basic fuel injection amount Tp. Correction coefficients such as cold engine enrichment correction coefficient which is derived on the basis of the engine coolant temperature data Tw, air/fuel ratio dependent correction data (lambda control correction data) which is derived on the basis of the $O_2$ sensor signal for maintaining the air/fuel ratio at a stochiometric value and so forth, are derived for correcting the basic fuel injection amount Tp for optimizing fuel injection amount in view of the engine driving parameters.

Manner of derivation of the fuel injection amount for controlling fuel injection to be performed through the fuel injection valve 10 is well known technology and does not constitute essential feature of the present invention. Therefore, further detailed discussion concerning normal state fuel injection control will be neglected.

Figure 3:
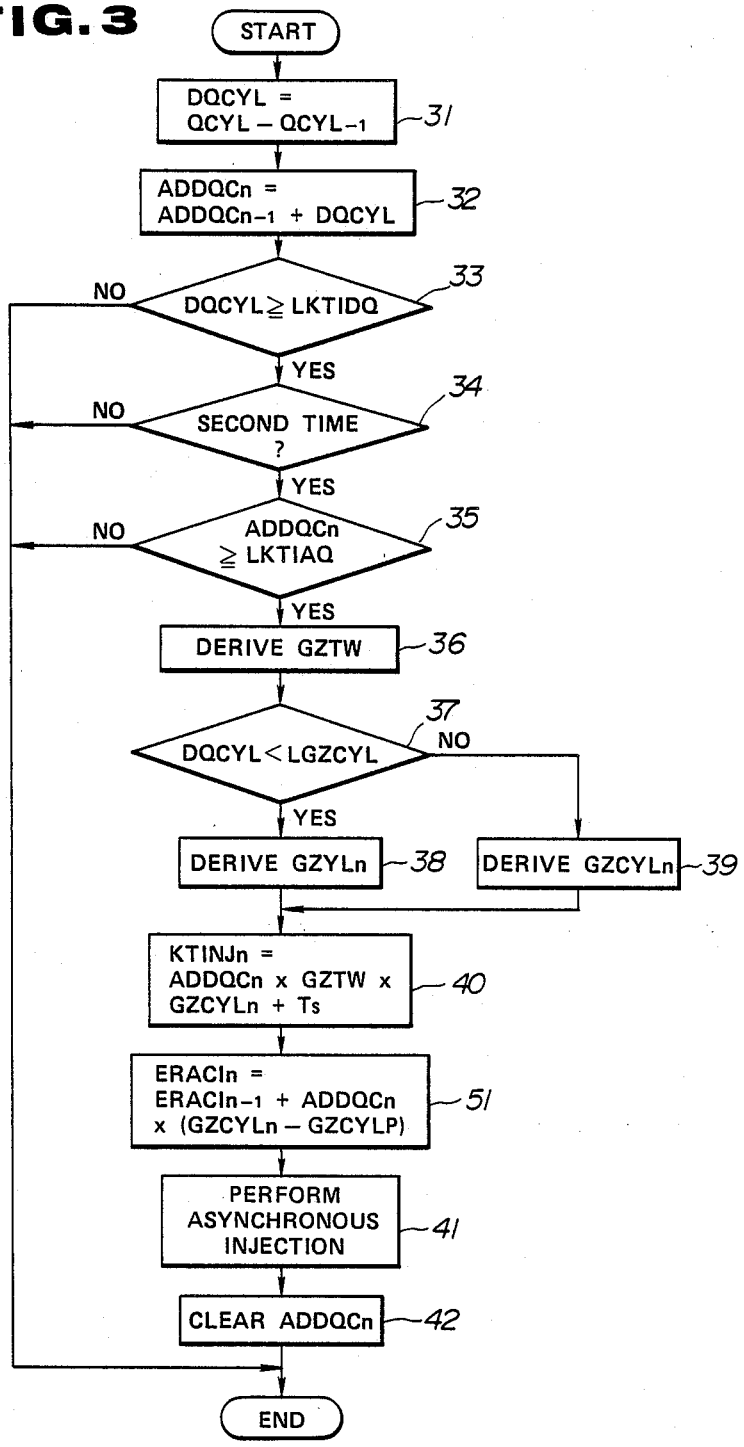
FIG. 3 is a flowchart showing operation of asynchronous fuel delivery control to be performed by the preferred embodiment of the air/fuel ratio control system of FIG. 2.

FIG. 3 shows preferred process for governing asynchronous fuel injection which is initiated in response to an acceleration enrichment demand. In the practical control, acceleration enrichment demand is detected in view of throttle value angular displacement to increase the throttle valve open angle. In the preferred process illustrated in FIG. 3, acceleration enrichment demand is detected every time the throttle angular position indicative signal TVO increases. Therefore, an asynchronous fuel injection control routine of FIG. 3 can be triggered in response to variation of the throttle valve angular position indicative data TVO. However, in the shown process, the asynchronous injection control routine is triggered every given interval, e.g. every 10 ms.

Immediately after starting execution of the routine of FIG. 3, the intake air flow rate data QCYL derived on the basis of the throttle valve angular position indicative data TVO is read out at a step 31. In the step 31, the intake air flow rate data $QCYL_{-1}$ which is intake air flow rate data derived in immediately preceding execution cycle, is also read out. On the basis of the read intake air flow rate data QCYL and $QCYL_{-1}$, an engine load variation data DQCYL is derived, at the step 31. This engine load variation data DQCYL is representative of the engine load variation during one execution cycle.

At a step 32, an integrated value ADDQCn of the engine load variation data DQCYL of each engine cylinder is obtained. In the practical operation, the integrated value ADDQCn is derived by adding the engine load variation data DQCYL derived at the step 31 to an integrated value $ADDQCn_{-1}$ derived immediately preceding execution cycle. The integrated values ADDQCn for respective engine cylinders are stored in memory blocks in a register of the control unit 100 identified by addresses given for storing integrated values of respective engine cylinders.

At a step 33, the engine load variation data DQCYL is compared with an engine load variation threshold LKTIDQ. When the engine load variation data DQCYL is smaller than the engine load variation threshold LKTIDQ, process directly goes END.

On the other hand, when the engine load variation data DQCYL is greater than or equal to the engine load variation threshold LKTIDQ, as checked at the step 33, check is performed at a step 34 whether the engine load variation data DQCYL greater than or equal to the engine load variation threshold LITIDQ is detected twice in sequence of execution cycles. In practice, in order to enable this to perform checking at the step 34, a flag FLDQ may be set in a flag register at the first occurrence of the engine load variation data DQCYL greater than the engine load variation threshold LKTIDQ. By this, the second and sequential occurrence of the the engine load variation data DQCYL greater than the engine load variation threshold LKTIDQ can be detected by checking the flag FLDQ.

When the sequentially occurring engine load variation data DQCYL greater than or equal to the engine load variation threshold LKTIDQ is detected at the step 34, the integrated values ADDQCn of respective engine cylinder are compared with an asynchronous injection threshold LKTIAQ at a step 35. When not all of the integrated values ADDQCn are greater than or equal to the asynchronous injection threshold LKTIAQ, process directly goes END. On the other hand, when all of the integrated values ADDQCn are greater than or equal to the asynchronous injection threshold LKTIAQ as checked at the step 35, an engine coolant temperature dependent correction coefficient GZTW is derived based on the engine coolant temperature data Tw at a step 36.

Figure 4:
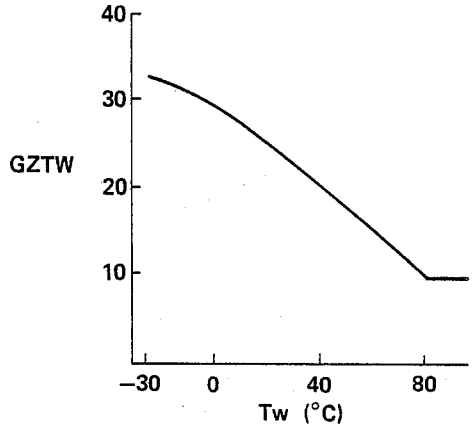
FIG. 4 is a graph showing variation of engine coolant temperature dependent correction coefficient GZTW in relation to an engine coolant temperature Tw.

The engine coolant temperature dependent correction coefficient GZTW is set in a form of a table to be read in terms of the engine coolant temperature Tw. Variation of the engine coolant temperature dependent correction coefficient GZTW in relation to the engine coolant temperature Tw is shown in FIG. 4.

At a step 37, the engine load variation data DQCYL is compared with a rapid acceleration threshold LGZCYL. The rapid acceleration threshold LGZCYL represents a predetermined engine load variation value DQCYL across which rapid acceleration and moderate acceleration are distinguished. Therefore, when the engine load variation data DQCYL is smaller than the rapid acceleration threshold LGZCYL as checked at the step 36, a moderate acceleration enrichment correction coefficient table for deriving an accelration enrichment correction coefficient GZCYLn is selected to derive the acceleration enrichment correction coefficient, at a step 38. On the other hand, when the engine load variation data DQCYL is greater than or equal to the rapid acceleration threshold LGZCYL as checked at the step 37, a rapid acceleration enrichment correction table is selected to derive the acceleration enrichment correction coefficient GZCYLn, at a step 39.

Figure 5:
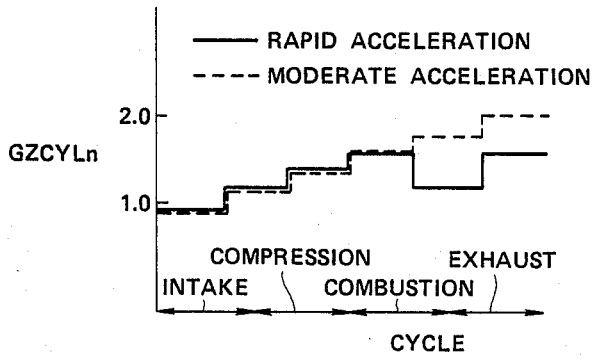
FIG. 5 is a chart showing variation of a correction coefficient GZCYLn for each individual engine cylinder.

It should be appreciated that the rapid and moderate acceleration enrichment correction coefficient tables defines acceleration enrichment correction coefficients which are variable of the values depending upon the engine revolution cycle position to perform the asynchronous injection, as shown in FIG. 5. Therefore, the acceleration enrichment correction coefficient GZCYLn is determined in terms of the engine revolution cycle, as shown in FIG. 5.

At a step 40, fuel injection amount KTINJn for asynchronous injection for each engine cylinder is calculated. The asynchronous fuel injection amount KTINJn is derived by the following equation:

$$KTINJn = ADDQCn \times GZTW \times GZCYLn + Ts$$

where Ts is battery voltage compensation value.

After deriving the asynchronous fuel injection amount KTINJn is derived at the step 40, asynchronous fuel injection is performed at a step 41. In asynchronous fuel injection, respective asynchronous fuel injection amounts KTINJn for respective engine cylinders is set to drive respective driver circuits for simultaneously driving the fuel injection valves 10. After asynchronous fuel injection at the step 41, all of the integrated values ADDQCn are reset at a step 42.

Under certain vehicular driving condition, such as during hill climbing, depression magnitude is increased gradually at a small rate, which depression increasing rate is small enough so as not to cause acceleration enrichment demand. When the aforementioned asynchronous injection control is not performed during moderate acceleration, in which closed loop control is disabled and open loop control is performed, the fuel amount cannot be increased to follow increasing of the engine load. Therefore, air/fuel ratio becomes leaner and far away from the stoichiometric value. This creates difficulty in switching control mode from open loop mode to closed loop. Therefore, in transition state, air/fuel ratio becomes unstable for degrading transition characteristics. In the preferred embodiment of the air/fuel ratio control as set forth above, increasing of the engine load during moderate acceleration state, can be compensated by intermittent asynchronous injection. This improves transition characteristics in swtiching control mode from open loop to closed loop.

Figure 6:
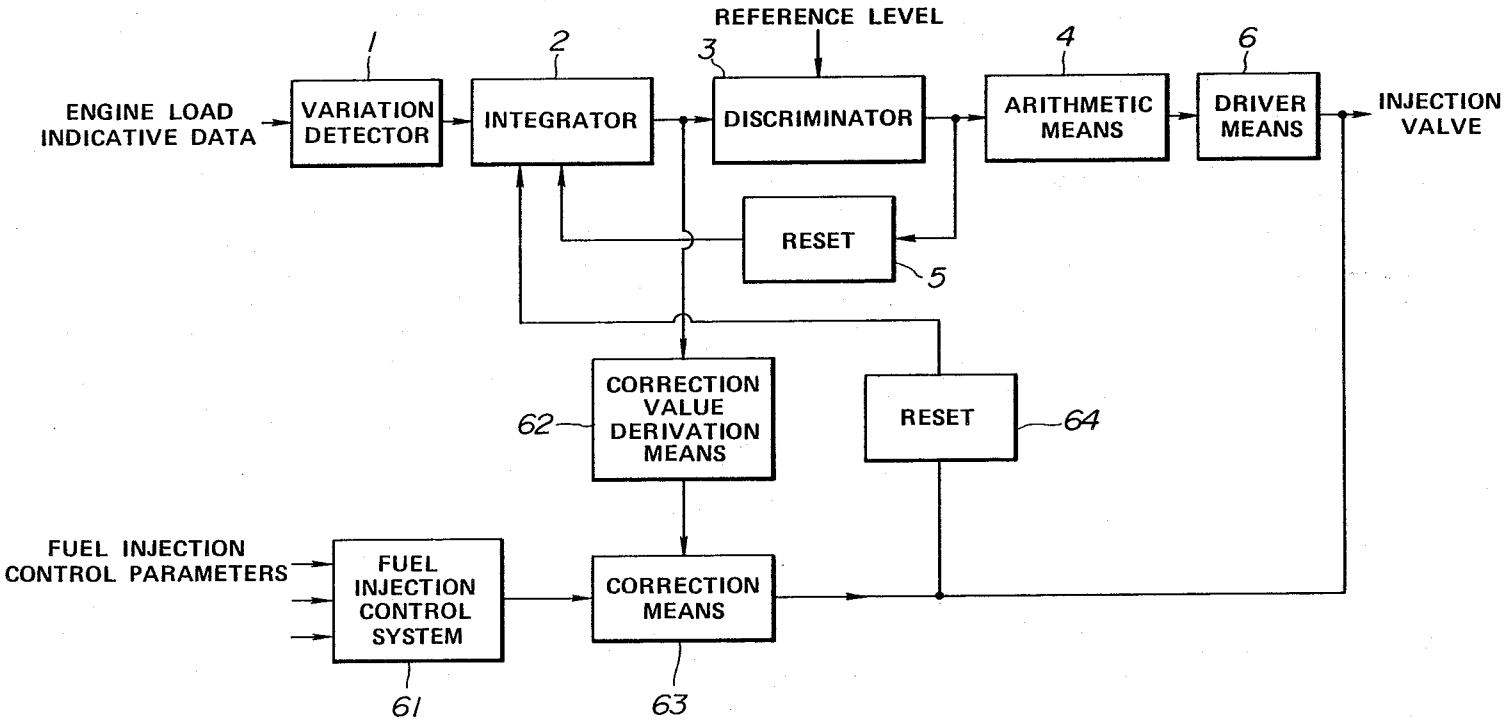
FIG. 6 is a schematic block diagram of the second embodiment of an air/fuel ratio control system according to the present invention.

FIG. 6 is a block diagram of another embodiment of the air/fuel ratio control system according to the invention. In this embodiment, normal fuel injection control system for performing fuel injection synchronously with engine revolution cycle, is associated with the asynchronous fuel injection control system. In FIG. 6, the normal fuel injection control system is shown in a form of a function block and represented by the reference numeral 61. The normal fuel injection control system 61 derives the fuel injection amount Ti. The normal fuel injection control system 61 is connected to a correction means 63. On the other hand, the integrator means 2 is connected to the correction means 63 via a correction value derivation means 62. The correction value derivation means 62 receives the integrated value from the integrator means 2 to feed a correction value to the collection means 63. The correction means 63 corrects the fuel injection amount Ti utilizing the correction value input from the correction value derivation means 62.

A reset means 64 is provided and connected to the integration means 2 to feed a reset signal for clearing the integrated value. The reset means 64 is responsive to occurrence of correction for the synchronous fuel injection amount Ti.

Figure 7:
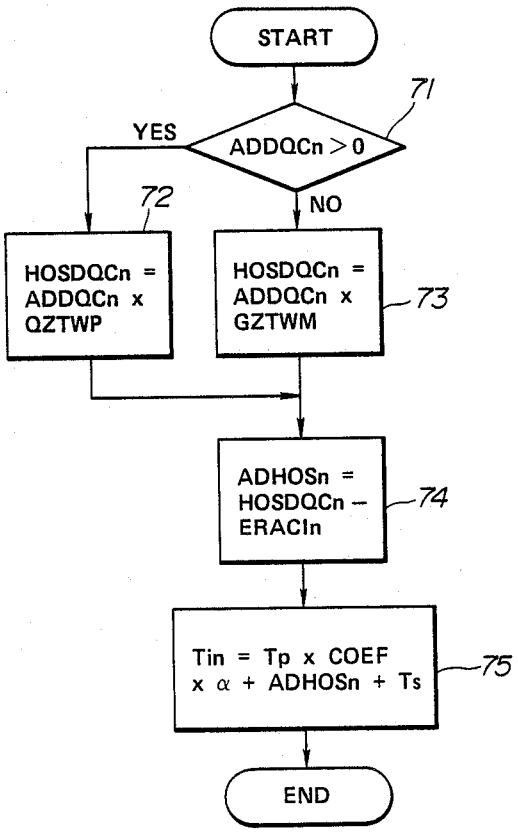
FIG. 7 is a flowchart of a routine for deriving a fuel injection amount Ti.

Practical air/fuel ratio control operation corresponding to air/fuel ratio control to be performed by the control system of FIG. 6 will be discussed herebelow with reference to FIGS. 7 to 9. As will be seen from FIG. 7, the asynchronous injection control routine is essentially the same as that discussed with respect to FIG. 3. In the shown routine, a step 51 is inserted between the steps 40 and 41. In the step 51, an error value ERACn is derived by the following equation:

$$ERACn = ADDQCn \times (GZCYLn - GZCYLP)$$

wherein GZCYLP is a constant correction rate, which correction rate is variable depending upon the fuel injecting direction through the fuel injection valve and can be within a range of 1.0 to 2.0.

At the step 51, the error value ERACn is integrated to obtain an integrated error value ERACIn. Practically, integrated error value ERACIn is derived by adding the error value ERACn to the integrated error value $ERACIn_{-1}$ which is the integrated error value derived in the immediately preceding cycle of execution.

Figure 8:
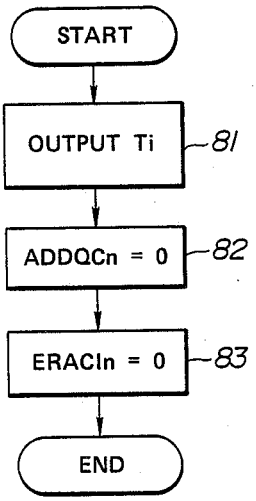
FIG. 8 is a flowchart of a routine for controlling a fuel injection timing.

FIG. 8 shows a routine for deriving the synchronous fuel injection amount Ti. At a step 71, the integrated value ADDQCn is checked for discriminating the engine driving condition. Namely, when the integrated value ADDQCn is greater than zero (0), the integrated value indicative accelerating state of the engine. On the other hand, when the integrated value ADDQCn is not greater than zero, and therefore smaller than or equal to zero, judgement can be made that the engine is not in accelerating state.

When the engine accelerating state is detected as checked at the step 71, a transition correction coefficient HOSDQCn is derived by utilizing an accelerating state engine coolant temperature dependent correction coefficient table which contains engine coolant temperature dependent correction coefficients GZTWP, at a step 72. In practice, the transition correction coefficient HOSDQCn is derived by:

$$HOSDQCn = ADDQCn \times GZTWP$$

On the other hand, when the engine driving state as checked at the step 71 is other than the acceleration state, deceleration state engine coolant temperature dependent correction coefficient table which contain engine coolant temperature dependent correction coefficient GZTWM is used for transition correction coefficient HOSDQCn, at a step 73. At the step 73, the transition correction coefficient HOSDQCn can be derived by:

$$HOSDQCn = ADDQCn \times GZTWM$$

After one of the steps 72 and 73, process goes to a step 74, synchronous injection component ADHOSn of transition correction coefficient is derived. The synchronous injection component ADHOSn is derived by utilizing the integrated error value ERACIn derived at the step 51 of the routine of FIG. 7. The ADHOSn can be derived by the following equation:

$$ADHOSn = HOSDQCn - ERACIn$$

FIG. 10 shows variation of the acceleration state and deceleration state engine coolant temperature dependent correction coefficients GZTWP and GZTWM in relation to the engine coolant temperature Tw. Therefore, these engine coolant temperature dependent correction values GZTWP and GZTWM are set in forms of tables to be read in terms of the engine coolant temperature Tw.

The synchronous injection component ADHOSn is correction coefficient for synchronous fuel injection for compensating the error of the air/fuel ratio caused in asynchronous injection.

At a step 75, correction of the basic fuel injection amount Tp is performed for determining fuel injection amount Tin for each engine cylinder. The fuel injection amount Tin is derived by the following equation:

$$Tin = Tp \times COEF \times KLAMBDA + ADHOSn + Ts$$

wherein COEF is a correction coefficients, such as engine coolant temperature dependent correction value, acceleration enrichment correction value, engine start-up correction coefficient, air density dependent correction coefficient and so forth; and KLAMBDA is a feedback correction value derived on the basis of the $O_2$ sensor signal value.

Figure 9:
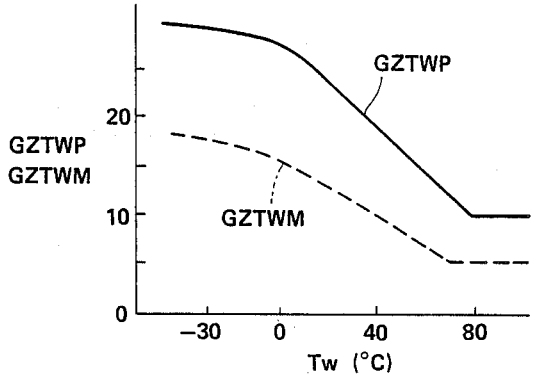

FIG. 9 shows a routine for performing fuel injection. The shown routine is triggered at a controlled timing in synchronism with engine revolution cycle so that fuel injection can be performed in synchronism with the engine revolution.

At a step 81, the fuel injection pulse having pulse width corresponding to the fuel injection amount Tin, is output in order to drive the corresponding fuel injection valve 10. After performing fuel injection at the step 81, the integrated value ADDQCn is cleared at a step 82 and the integrated error value ERACIn is cleared at a step 83.

In the aforementioned second embodiment of the air/fuel ratio control system, ratio of the integrated error value ERACIn to be compensated in synchronous injection and asynchronous injection is determined by the asynchronous injection threshold LKTIAQ. Namely, when the asynchronous injection threshold LKTIAQ is set at a small value, frequency of asynchronous injection is increased. Higher frequency of occurrence of asynchronous injection may improve response characteristics to increasing of the engine load. On the other hand, higher frequency of asynchronous injection will shorten the asynchronous fuel injection pulse width. Too short fuel injection pulse width will cause inaccuracy of fuel metering amount due to non-linear characteristics of the fuel injection valve. In view of this, the asynchronous injection threshold LKTIAQ is preferred to be set at a value to maintain fuel injection pulse width long enough to assure accurate fuel metering.

Furthermore, in the second embodiment of the air/fuel ratio control system, since the fuel injection amount greater than or smaller than the desired value in asynchronous injection can be quickly compensated in synchronous injection. Therefore, stability in air/fuel ratio control can be satisfactorily provided.

Therefore, the present invention can fulfill all of the objects and advantages sought therefor.

What is claimed is:

1. An air/fuel ratio control system comprising:

a fuel metering means for metering a controlled amount of fuel into flow of intake air for establishing an air/fuel mixture;

an engine speed sensor for monitoring an engine revolution speed for producing an engine speed indicative signal;

an engine load sensor for monitoring an engine load for producing an engine load signal;

first means for detecting variation of said engine load for generating an engine load variation data;

second means for detecting variation magnitude of engine load exceeding a predetermined threshold value for producing a detecting signal;

third means for deriving a fuel metering amount and controlling said fuel metering means in order to meter derived first amount of fuel to said intake air flow at a controlled timing normally in synchronism with engine revolution cycle, said third means being responsive to said detecting signal for deriving a second fuel metering amount so as to meter derived amount of fuel at a timing irrespective of the engine revolution cycle.

2. An air/fuel ratio control system as set forth in claim 1, wherein said second means integrates said engine load variation data for deriving engine load variation magnitude and compares integrated value with said predetermined threshold for detecting the engine load variation magnitude exceeding said threshold.

3. An air/fuel ratio control system as set forth in claim 1, wherein said third means further derives a transition compensating correction coefficient for correcting said first metering amount on the basis of deviation of said second fuel metering amount and necessary fuel metering amount which is derived on the basis of said engine speed data and said engine load data for compensating said deviation.

4. An air/fuel ratio control system as set forth in claim 3, wherein said transition compensating correction coefficient is variable depending upon said engine load variation magnitude detected by said second means.

5. An air/fuel ratio control system as set forth in claim 1, wherein said third means derives an acceleration enrichment correction coefficient on the basis of said engine load variation magnitude detected by said second means for deriving said second fuel metering amount.

6. An air/fuel ratio control system as set forth in claim 5, said third means further detects engine load variation rate on the basis of said engine load variation data of said first means for discriminating rapid acceleration and moderate acceleration for differentiating and acceleration enrichment correction coefficient depending thereon.

7. An air/fuel ratio control system as set forth in claim 2, wherein said second means is responsive to fuel metering irrespective of engine revolution cycle to clear said integrated value.

8. An air/fuel ratio control system comprising:

a fuel injection valve for injecting a controlled amount of fuel into intake air flowing through an air induction passage for establishing an air/fuel mixture;

an engine speed sensor for monitoring an engine revolution speed for producing an engine speed indicative signal;

an engine load sensor for monitoring an engine load for producing an engine load indicative signal;

first means for monitoring variation of engine load detecting variation of said engine load indicative signal value and generating an engine load variation magnitude indicative data;

second means, receiving said engine load variation magnitude indicative data, for deriving a total engine load variation magnitude, said second means being detective of said total engine load variation magnitude exceeding a predetermined threshold value for producing a detecting signal;

third means, normally operating in synchronous injection mode, for deriving a fuel injection amount and controlling said fuel injection valve in order to inject derived first amount of fuel to said intake air flow at a controlled timing normally in synchronism with engine revolution cycle, said third means being responsive to said detecting signal to be triggered an asynchronous injection mode for deriving a second fuel injection amount so as to inject derived second amount of fuel at a timing determined irrespective of the engine revolution cycle.

9. An air/fuel ratio control system as set forth in claim 8, wherein said second means integrates said engine load variation magnitude indicative data for deriving said total engine load variation magnitude and compares integrated value with said predetermined threshold for detecting the total engine load variation magnitude exceeding said threshold.

10. An air/fuel ratio control system as set forth in claim 8, wherein said third means further derives a transition compensating correction coefficient for correcting said first injection amount on the basis of deviation of said second fuel injection amount and necessary fuel injection amount which is derived on the basis of said engine speed data and said engine load data for compensating said deviation.

11. An air/fuel ratio control system as set forth in claim 10, wherein said transition compensating correction coefficient is variable depending upon said engine load variation magnitude detected by said second means.

12. An air/fuel ratio control system as set forth in claim 8, wherein said third means derives an acceleration enrichment correction coefficient on the basis of said engine load variation magnitude detected by said second means for deriving said second fuel injection amount.

13. An air/fuel ratio control system as set forth in claim 12, said third means further detects engine load variation rate on the basis of said engine load variation data of said first means for discriminating rapid acceleration and moderate acceleration for differentiating said acceleration enrichment correction coefficient depending thereon.

14. An air/fuel ratio control system as set forth in claim 9, wherein said second means is responsive to fuel injection irrespective of engine revolution cycle to clear said integrated value.

* * * * *